US006692077B1

(12) United States Patent
Beggs et al.

(10) Patent No.: US 6,692,077 B1
(45) Date of Patent: Feb. 17, 2004

(54) HEIGHT ADJUSTMENT CHAIR CONTROL

(75) Inventors: Kenneth Beggs, Waterloo (CA); Gerard J. Matern, Waterloo (CA)

(73) Assignee: Leggett & Platt Ltd., Waterloo (CA)

( * ) Notice: Subject to any disclaimer, the term of this patent is extended or adjusted under 35 U.S.C. 154(b) by 0 days.

(21) Appl. No.: 10/400,603

(22) Filed: Mar. 27, 2003

(51) Int. Cl.[7] ..... A47C 1/02
(52) U.S. Cl. ..... 297/344.19
(58) Field of Search ..... 297/344.19, 463.1; 248/404

(56) References Cited

U.S. PATENT DOCUMENTS 4,373,692 A * 2/1983 Knoblauch et al.
5,280,998 A * 1/1994 Miotto et al.
5,427,434 A * 6/1995 Hybarger
6,224,155 B1 * 5/2001 DeKraker et al.
6,352,308 B1 * 3/2002 Chen
2002/0163242 A1 * 11/2002 Beggs

* cited by examiner

*Primary Examiner*—Milton Nelson, Jr.
(74) *Attorney, Agent, or Firm*—Shook, Hardy & Bacon LLP

(57) ABSTRACT

A chair height adjustment mechanism includes a lever positioned to overlay a valve opening member of a height adjusting cylinder. The lever may be depressed by a cam on a control arm when the control arm is rotated. The depressed lever then depresses the valve opening member. Depression of the lever through the rotation of the control arm may give finer control to the depression of the valve opening member than is conventional.

12 Claims, 4 Drawing Sheets

HEIGHT ADJUSTMENT CHAIR CONTROL

FIELD OF THE INVENTION

The present invention relates to height adjustable chairs and, in particular, to a height adjustment mechanism for such chairs.

BACKGROUND

As the users of chairs are of myriad sizes, various aspects of some chairs have been made adjustable. One such aspect is the height of the seat. Typically, the adjustability of the height of the seat is provided by a gas cylinder having two-chambers separated by a normally closed valve. Such a gas cylinder generally terminates in a valve opening member at its top end, which valve opening member is biased to an extended position whereat the valve is closed. A user actuator is supplied to depress the valve opening member in order to open the cylinder valve to permit height adjustment of the seat. A known user actuator comprises a lever tiltably mounted in a housing above the valve opening member. The lever often terminates in a paddle. With such an actuator, the user may depress the valve opening member by raising the paddle. Such an actuator may have a limited range of movement and, therefore, limited granularity in pressure applied when raising the paddle to depress the valve opening member.

SUMMARY

A chair height adjustment mechanism includes a lever positioned to overlay a valve opening member of a height adjusting cylinder. The lever may be depressed by a cam on the end of a control arm when the control arm is rotated. When the lever is depressed it depresses the valve opening member.

Advantageously, the control arm of such a chair height adjustment mechanism preferably rotates through about 90 degrees, thereby providing a greater range of movement than typical rod-type chair height adjustment mechanisms. The greater range of movement allows for finer granularity in applying pressure to depress the valve opening member and therefore allows finer adjustments to the chair height.

In accordance with an aspect of the present invention there is provided a height adjustment mechanism for a chair. The height adjustment mechanism includes a second class lever pivotally attached to a main frame, the lever overlying an opening for reception of a valve opening member of a height adjusting cylinder, a control arm supported by the main frame and a cam mounted on the control arm. The cam is positioned to depress the lever, responsive to rotation of the control arm, such that the lever depresses the valve opening member when the valve opening member is received by the opening.

In accordance with an aspect of the present invention there is provided a chair. The chair includes a height adjusting cylinder having a control valve and a valve opening member adapted to open the control valve, a seat and a height adjustment mechanism adapted to secure the seat to the height adjusting cylinder. The height adjustment mechanism includes a second class lever pivotally attached to a main frame, the lever overlying the valve opening member of the height adjusting cylinder, a control arm supported by the main frame and a cam mounted on the control arm. The cam is positioned to depress the lever, responsive to rotation of the control arm, such that the lever depresses the valve opening member.

In accordance with an aspect of the present invention there is provided a height adjustment mechanism for a chair. The height adjustment mechanism includes a pivot bar mounted to a main frame, a lever pivotally attached to the pivot bar, the lever overlying an opening for reception of a valve opening member of a height adjusting cylinder, a control arm supported by the main frame, a cam mounted on the control arm, the cam positioned to depress the lever, responsive to rotation of the control arm, such that the lever depresses the valve opening member when the valve opening member is received by the opening and a biasing member to bias the lever against the cam and away from the opening.

In accordance with an aspect of the present invention there is provided a chair. The chair includes a height adjusting cylinder having a control valve and a valve opening member adapted to open the control valve, a seat and a height adjustment mechanism adapted to secure the seat to the height adjusting cylinder. The height adjustment mechanism includes a pivot bar mounted to a main frame, a lever pivotally attached to the pivot bar, the lever overlying the valve opening member of the height adjusting cylinder, a control arm supported by the main frame, a cam mounted on the control arm, the cam positioned to depress the lever, responsive to rotation of the control arm, such that the lever depresses the valve opening member and a biasing member to bias the lever against the cam and away from the opening.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate example embodiments of this invention.

DETAILED DESCRIPTION

Figure 1:
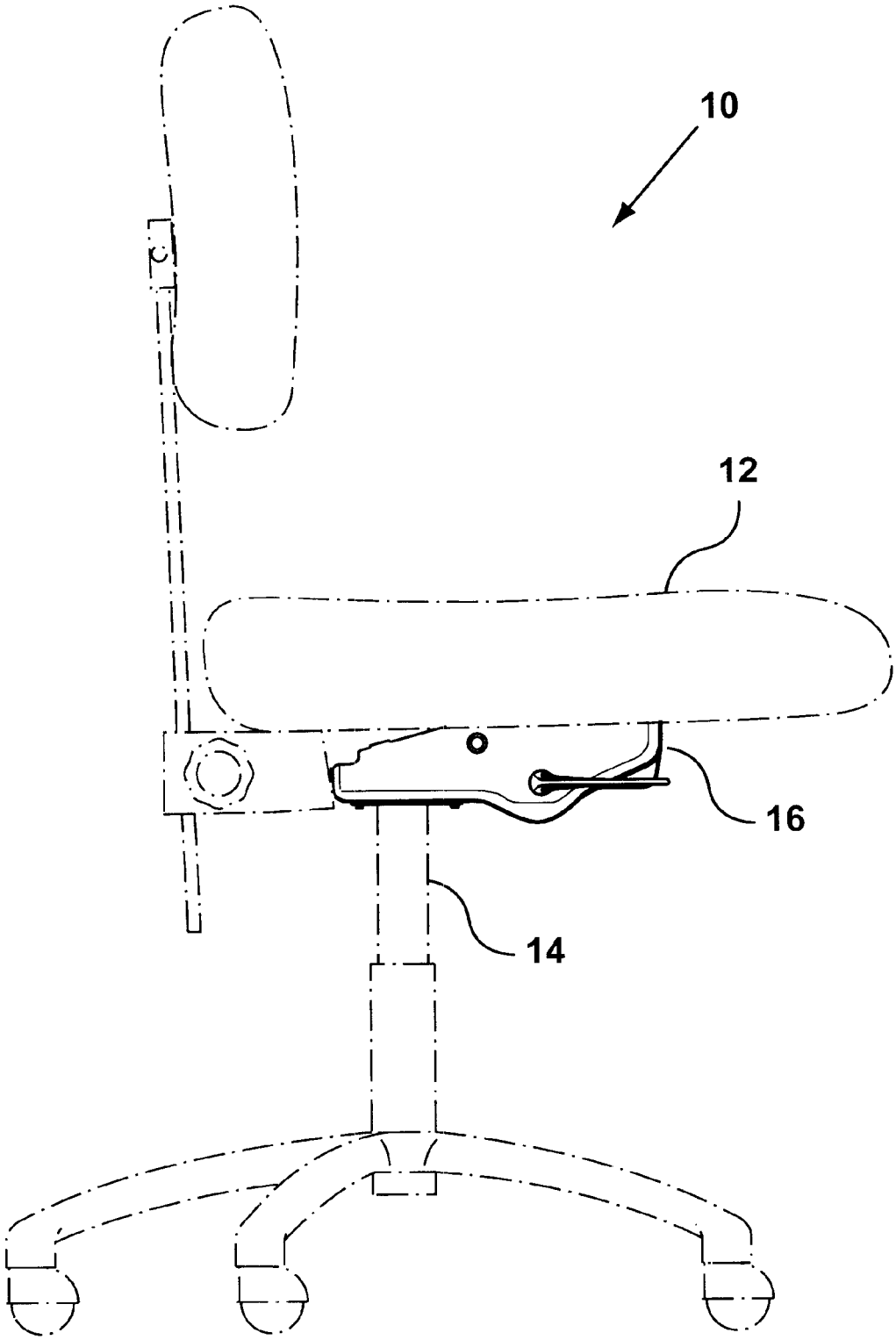
FIG. 1 is a schematic side view of a chair including an embodiment of the subject invention.

In the schematic side view of a chair 10 presented in FIG. 1, the chair 10 includes a seat 12 secured to a chair height adjustment mechanism 16 that is secured to a height adjusting cylinder 14.

Figure 2:
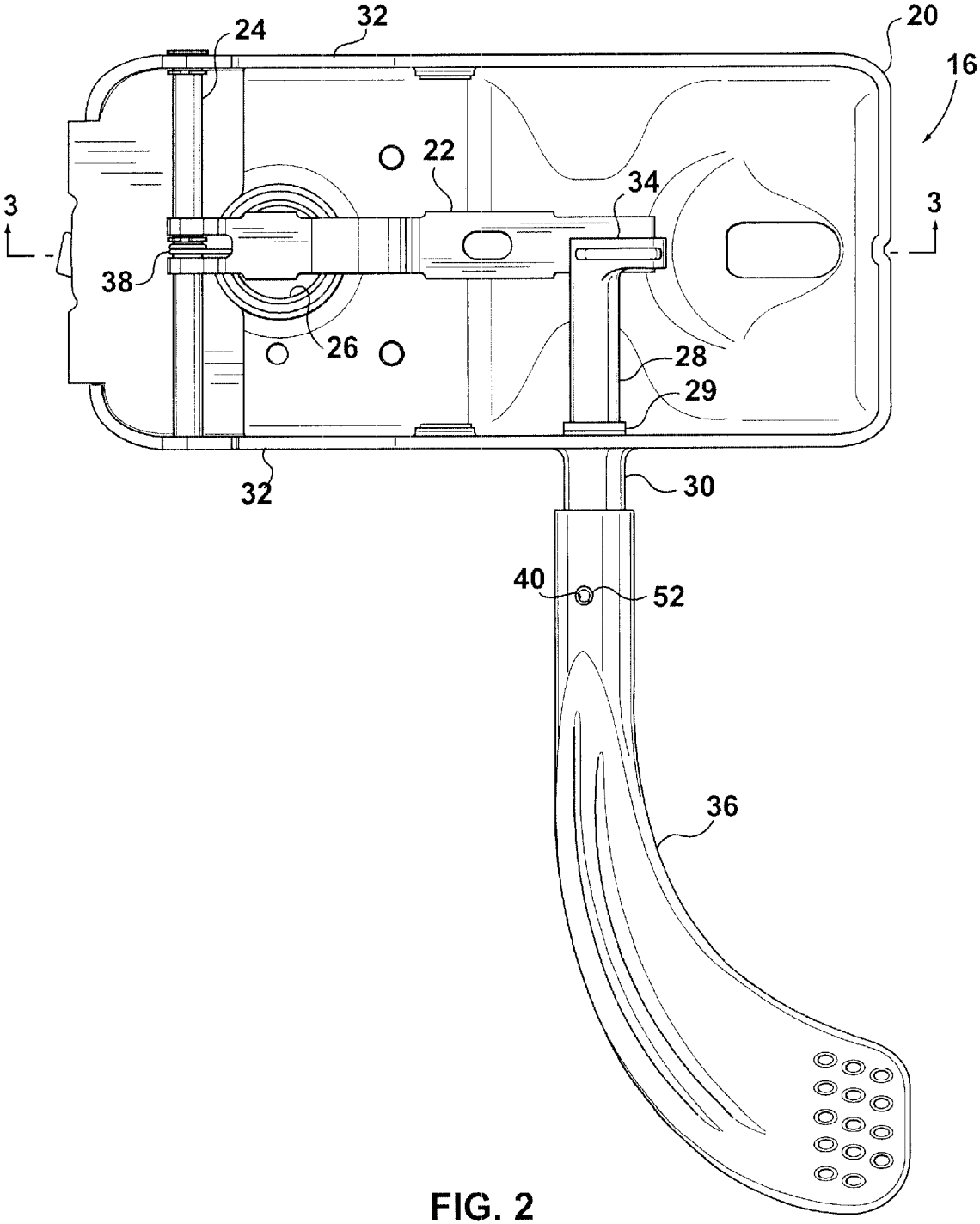
FIG. 2 is a schematic top view of a chair adjustment mechanism including a lever overlaying a valve opening member according to an embodiment of the present invention.

As illustrated in more detail in FIG. 2, the chair height adjustment mechanism 16 includes a main frame 20. A lever 22 is pivotally mounted to the main frame 20 on a pivot bar 24. The main frame 20 has side walls 32 that support the pivot bar 24. The lever 22 is positioned along the pivot bar 24 so that the lever 22 will at least partially overlie a gas cylinder aperture 26 in which the height adjusting cylinder 14, for instance, a gas cylinder, will normally be installed. More particularly, the lever 22 is positioned along the pivot bar 24 so that the lever 22 at least partially overlies a valve opening member 15 used to actuate the gas cylinder.

Figure 4:
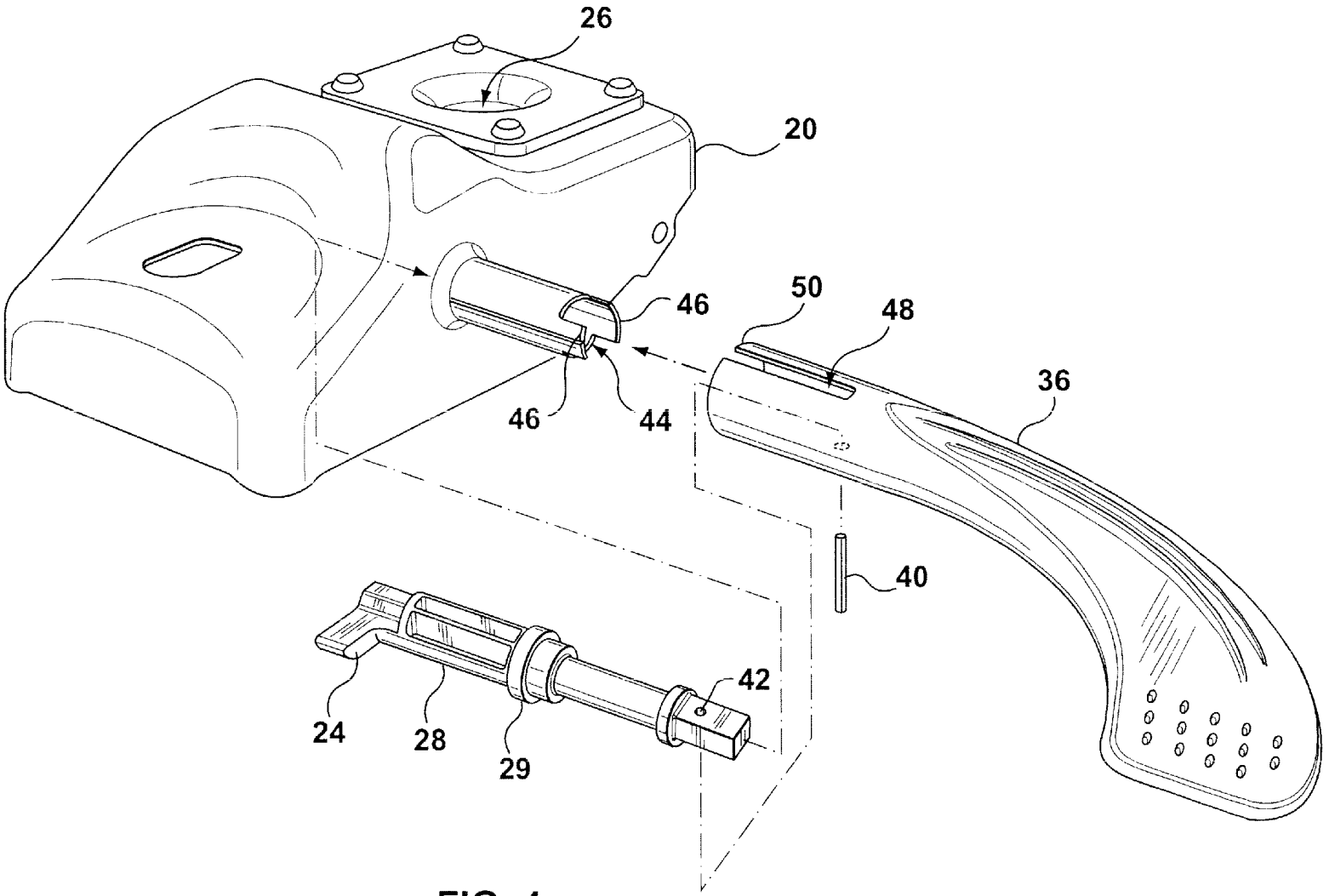
FIG. 4 is a schematic, underside, perspective, exploded view of the chair control mechanism of FIG. 2.
Figure 4:
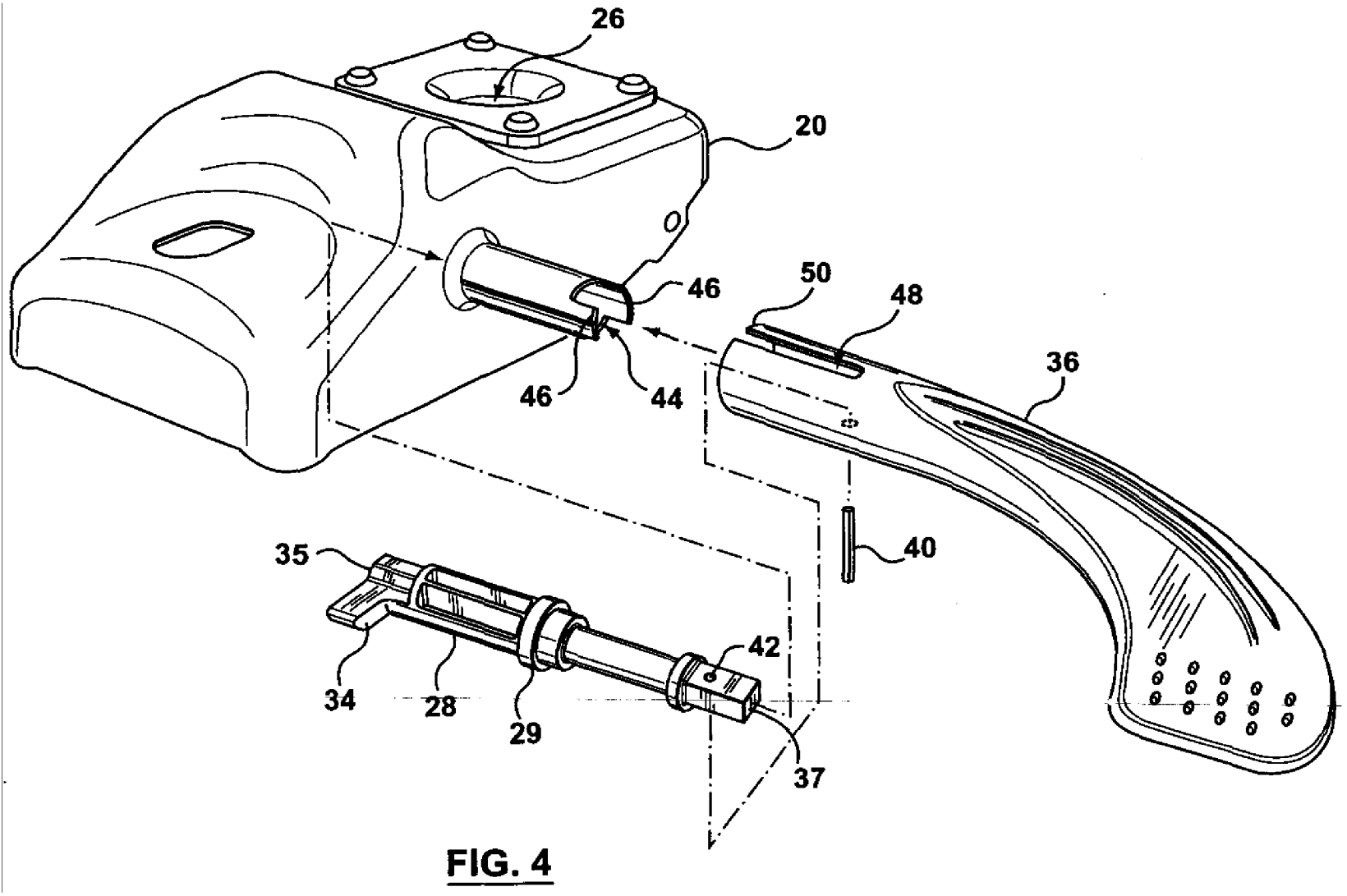

A control arm 28 may be supported by a bushing 30 extending outwardly from one side wall 32 of the main frame 20 so that a cam 34, at an inside end 35 of the control arm 28, is positioned to overlie the lever 22. An outside end 37 of the control arm 28 is provided with a paddle 36 to assist the manual rotation of the control arm 28. As illustrated in FIG. 4, a channel 48 extends inward from the end 50 of the paddle. The side of the paddle 36 opposite the channel 48 is provided with an aperture 52 (see FIG. 2).

An outer end 44 of the bushing 30 (the end that is not connected to the main frame 20) may be provided with two extensions (or stops) 46 defining two notches.

A spring 38, coiled around the pivot bar 24, biases the lever 22 away from the valve opening member 15 and towards the cam 34 at the inside end 35 of the control arm 28. The biasing of the lever 22 against the cam 34 acts to eliminate play in the lever 22 when the lever 22 is not being used to adjust the height of the seat.

The control arm 28, once installed in the bushing 30 has limited axial freedom. This is due to a fixing pin 40 abutting the outer end 44 of the bushing 30 once the control arm 28 is installed in the bushing 30, thereby restricting inward movement of the control arm 28. Similarly, to restrict outward movement of the control arm 28, the control arm 28 may have a flange 29. The flange 29 abuts the side wall 32 of the main frame 20 when the control arm 28 is installed in the bushing 30.

During installation, the control arm 28 is inserted into the bushing 30 from the inside of the main frame 20. The flange 29 acts to limit the extent to which the control arm 28 is allowed to be inserted into the bushing 30. The fixing pin 40 may then be inserted into a passageway 42 in the control arm 28 (see FIG. 4) such that the fixing pin 40 projects from each end of the passageway 42. Once the control arm 28 has been inserted into the bushing 30 and the fixing pin 40 has been installed in the control arm 28, the extensions 46 of the bushing 30 limit rotation of the control arm 28 by abutting the fixing pin 40 at the clockwise and counter-clockwise extent of the allowed rotation.

Additionally, the fixing pin 40 may be used to mount the paddle 36 to the control arm 28 as follows. During the installation of the fixing pin 40 in the control arm 28, the installer may pause while the fixing pin 40 is partially inserted such that it projects from one end of the passageway 42 in the control arm 28, but not from the other. At this point, open end 50 of the paddle 36 may be slid over the bushing 30 such that the projecting fixing pin 40 passes along the channel 48 of the paddle 36. Once the paddle 36 has been received over the bushing 30 to the extent allowed by the channel 48, the installation of the fixing pin 40 may continue such that the fixing pin projects out from the other side of the control arm 28 and is received in the aperture 52 of the paddle 36.

The size and shape of the notches in the bushing 30 may allow the paddle 36, and consequently the control arm 28, to be rotated through about 90 degrees. The biasing of the lever 22 against the cam 34 acts to maintain, in the absence of an overcoming force, the combination of the paddle 36 and the control arm 28 at one end of their rotational path.

Figure 3A:
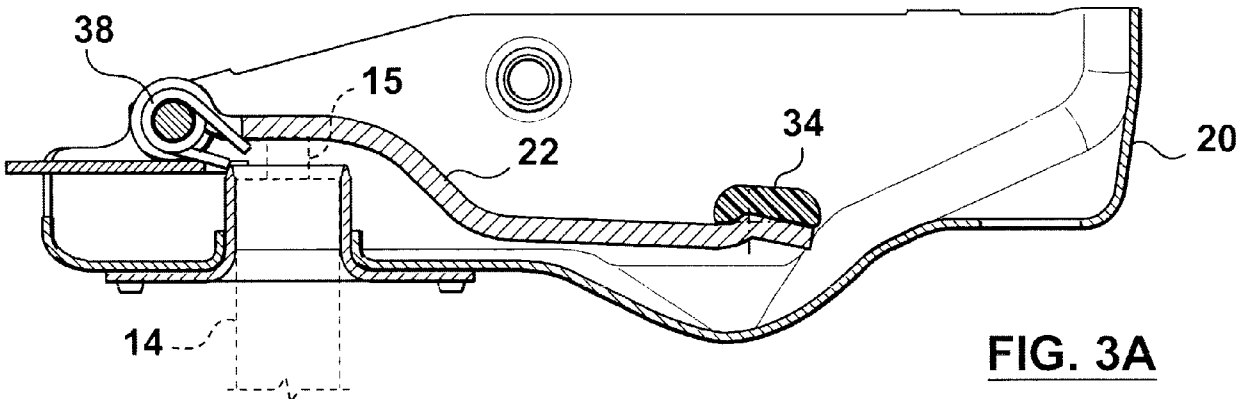
FIG. 3A is a sectional view of the chair adjustment mechanism of FIG. 2 taken substantially along line 3—3 of FIG. 2, wherein the lever is in a rest position.

In operation, a user may rotate the control arm 28 such that the cam 34 depresses the lever 22. FIG. 3A illustrates the lever 22 in a lever rest position. In the rest position, the lever overlays the valve opening member 15. Since gas cylinders manufactured by diverse parties may have valve opening members having slightly different heights, it is possible that the lever 22 will, in some cases, touch the valve opening member 15 when in the lever rest position and, in other cases, there may be clearance between the lever 22 and the valve opening member 15 when in the lever rest position.

Figure 3B:
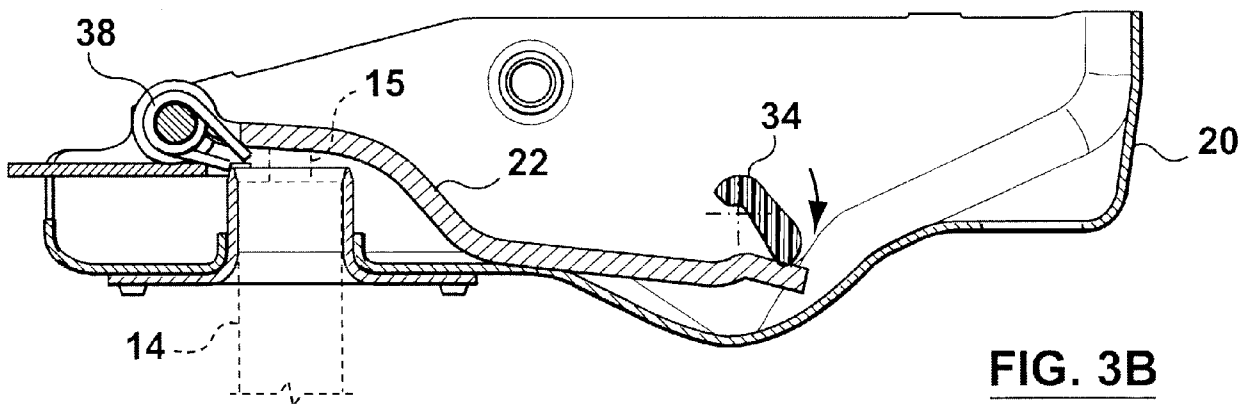
FIG. 3B is a sectional view of the chair adjustment mechanism of FIG. 2 taken substantially along line 3—3 of FIG. 2, wherein the lever is in a depressed position.

As illustrated in FIG. 3B, as a result of rotation of the control arm 28, the cam 34 depresses the lever 22. The lever 22, when depressed by the cam 34, depresses the valve opening member 15 thereby allowing the user to change the height of the chair.

As will be apparent to a person skilled in the art, if a downward force, say, gravity on a person sitting in seat 10 (FIG. 1), is applied to the height adjusting cylinder 14 when the lever 22 depresses the valve opening member 15, the height of the chair will be reduced. In the absence of such a downward force when the lever 22 depresses the valve opening member 15, the height of the chair will be increased.

Advantageously, the user may control the depth of depression of the valve opening member 15 with fine granularity. The degrees of control depends on the class of lever used and the length of the lever. As shown, the height adjustment mechanism 16 is a second class lever system with the length of the lever 22 extending through a majority of the long dimension of the main frame 20. Through the fine granularity control of the opening of the valve afforded by the height adjustment mechanism 16, the user may control the speed of adjustment of the height of the chair. For instance, for a very slight adjustment in the height of the chair, a very slow speed of adjustment would be preferred.

As will be apparent to a person skilled in the art, many shapes are available for the cam 34, besides that which is disclosed by the drawings. Additionally, it will be apparent to a person skilled in the art that the cam 34 need not be positioned precisely at the inside end 35 of the control arm 28. The control arm 28 could, for example, extend from one side wall 32 of the main frame 20 to the other side wall 32, with the cam 34 positioned along the control arm 28 to depress the lever 22.

As will be apparent to a person skilled in the art, the control arm 28 may be manufactured of a material that is easily moldable to the required shape, such as a plastic. Additionally, the lever 22 may be manufactured of a material that prevents deflection during activation, such as steel.

Other modifications will be apparent to those skilled in the art and, therefore, the invention is defined in the claims.

We claim:

1. A height adjustment mechanism for a chair comprising:

a second class lever pivotally attached to a main frame, said lever overlying an opening for reception of a valve opening member of a height adjusting cylinder;

a control arm supported by said main frame; and a cam mounted on said control arm, said cam positioned to depress said lever, responsive to rotation of said control arm, such that said lever depresses said valve opening member when said valve opening member is received by said opening.

2. The height adjustment mechanism of claim 1 further comprising a pivot bar mounted to said main frame adapted to pivotally support said lever.

3. The height adjustment mechanism of claim 2 further comprising a biasing member to bias said lever against said cam and away from said opening.

4. The height adjustment mechanism of claim 3 wherein said biasing member is a coil spring wrapped around said pivot bar, where opposite ends of said coil spring are respectively biased against said lever and said main frame.

5. The height adjustment mechanism of claim 1 further comprising a paddle mounted to said control arm.

6. The height adjustment mechanism of claim 5 wherein said paddle extends radially from said control arm.

7. The height adjustment mechanism of claim 1 further comprising a bushing mounted to said main frame to support said control arm.

8. The height adjustment mechanism of claim 7 wherein said bushing includes stops to limit said rotation of said control arm.

9. The height adjustment mechanism of claim 8 wherein said stops limit said rotation to about 90 degrees.

10. A chair comprising:

a height adjusting cylinder having a control valve and a valve opening member adapted to open said control valve;

a seat;

a height adjustment mechanism adapted to secure said seat to said height adjusting cylinder, said height adjustment mechanism including:

a second class lever pivotally attached to a main frame, said lever overlying said valve opening member of said height adjusting cylinder;

a control arm supported by said main frame; and a cam mounted on said control arm, said cam positioned to depress said lever, responsive to rotation of said control arm, such that said lever depresses said valve opening member.

11. A height adjustment mechanism for a chair comprising:

a pivot bar mounted to a main frame;

a lever pivotally attached to said pivot bar, said lever overlying an opening for reception of a valve opening member of a height adjusting cylinder;

a control arm supported by said main frame;

a cam mounted on said control arm, said cam positioned to depress said lever, responsive to rotation of said control arm, such that said lever depresses said valve opening member when said valve opening member is received by said opening; and a biasing member to bias said lever against said cam and away from said opening.

12. A chair comprising:

a height adjusting cylinder having a control valve and a valve opening member adapted to open said control valve;

a seat;

a height adjustment mechanism adapted to secure said seat to said height adjusting cylinder, said height adjustment mechanism including:

a pivot bar mounted to a main frame;

a lever pivotally attached to said pivot bar, said lever overlying said valve opening member of said height adjusting cylinder;

a control arm supported by said main frame;

a cam mounted on said control arm, said cam positioned to depress said lever, responsive to rotation of said control arm, such that said lever depresses said valve opening member; and a biasing member to bias said lever against said cam and away from said opening.

* * * * *

UNITED STATES PATENT AND TRADEMARK OFFICE

CERTIFICATE OF CORRECTION

PATENT NO. : 6,692,077 B1
DATED : February 17, 2004
INVENTOR(S) : Beggs et al.

It is certified that error appears in the above-identified patent and that said Letters Patent is hereby corrected as shown below:

Drawings, replace Sheet 4, Fig. 4 with the attached replacement Sheet 4, Fig. 4

Signed and Sealed this

Eighteenth Day of January, 2005

JON W. DUDAS
*Director of the United States Patent and Trademark Office*